US010513003B2

(12) United States Patent
Ling et al.

(10) Patent No.: US 10,513,003 B2
(45) Date of Patent: Dec. 24, 2019

(54) PRECISION LAPPING AND POLISHING DEVICE FOR EXTERNAL CYLINDRICAL SURFACE OF THE DISK PART AND ITS TAPER ERROR ADJUSTMENT METHOD THEREOF

(71) Applicant: Dalian University of Technology, Dalian (CN)

(72) Inventors: Siying Ling, Dalian (CN); Kun Wang, Dalian (CN); Baodi Yu, Dalian (CN); Xiaodong Wang, Dalian (CN); Liding Wang, Dalian (CN)

(73) Assignee: DALIAN UNIVERSITY OF TECHNOLOGY, Liaoning (CN)

( * ) Notice: Subject to any disclaimer, the term of this patent is extended or adjusted under 35 U.S.C. 154(b) by 0 days.

(21) Appl. No.: 16/346,506

(22) PCT Filed: Jun. 13, 2017

(86) PCT No.: PCT/CN2017/088067
§ 371 (c)(1),
(2) Date: Apr. 30, 2019

(87) PCT Pub. No.: WO2018/227378
PCT Pub. Date: Dec. 20, 2018

(65) Prior Publication Data

US 2019/0291230 A1 Sep. 26, 2019

(51) Int. Cl.
*B24B 1/00* (2006.01)
*B24B 1/04* (2006.01)
*B24B 37/025* (2012.01)

(52) U.S. Cl.
CPC ..... *B24B 1/04* (2013.01); *B24B 1/00* (2013.01); *B24B 37/025* (2013.01)

(58) Field of Classification Search
CPC ..... B24B 1/00; B24B 1/04; B24B 37/025; B24B 41/06; B24B 49/16; B24B 51/00
(Continued)

(56) References Cited

U.S. PATENT DOCUMENTS 4,839,993 A * 6/1989 Masuko ..... B24B 19/226 451/283
5,938,511 A * 8/1999 Patterson ..... B24B 41/06 451/365
(Continued)

FOREIGN PATENT DOCUMENTS

CN 202162633 U 3/2012
CN 104191346 A 12/2014
(Continued)

*Primary Examiner* — George B Nguyen
(74) *Attorney, Agent, or Firm* — Muncy, Geissler, Olds & Lowe, P.C.

(57) ABSTRACT

The precision lapping and polishing device for external cylindrical surface of disk part and its taper error adjustment method. The device composes a circular baseplate, slant rails, baffles, pressure plates, copper blocks, a washer blanket; blanket plates, a set of bead shafting, a friction driving wheel, a DC motor, a mobile power supply, a LED lamp and a cover body. By adopting the working principle that the generatrix rotates around the fixed axis to form the cylindrical surface, the ultra-precision machining of the cylindrical surface of disk part is realized. The radial-continuous-automatic-micro feeding of the disk part is realized by thinning the thickness of the circular baseplate which is internally tangent to the generatrix of the circular baseplate during the process of lapping and polishing. The device has the advantages of operating simply, adjusting conveniently, low cost and is of important value for popularization and application.

10 Claims, 6 Drawing Sheets

(58) Field of Classification Search
USPC ..... 451/11, 283
See application file for complete search history.

(56) References Cited

U.S. PATENT DOCUMENTS

| | | | | | |
|---|---|---|---|---|---|
| 6,142,856 | A * | 11/2000 | Romhild | B24B 3/605 | 451/279 |
| 2014/0080386 | A1* | 3/2014 | Burner | B24B 27/0061 | 451/294 |
| 2015/0336235 | A1* | 11/2015 | Persson | B24B 41/06 | 451/361 |
| 2016/0121448 | A1* | 5/2016 | Huang | B24B 3/60 | 451/369 |

FOREIGN PATENT DOCUMENTS

| | | | |
|---|---|---|---|
| CN | 204913562 | U | 12/2015 |
| CN | 105479307 | A | 4/2016 |
| CN | 205218689 | U | 5/2016 |
| DE | 10 2008 050 660 | A1 | 4/2010 |
| WO | WO 2015/136350 | A1 | 9/2015 |

* cited by examiner

PRECISION LAPPING AND POLISHING DEVICE FOR EXTERNAL CYLINDRICAL SURFACE OF THE DISK PART AND ITS TAPER ERROR ADJUSTMENT METHOD THEREOF

FIELD OF THE INVENTION

The present invention involves a precision lapping and polishing device for external cylindrical surface of the disk part and its taper error adjustment method, which belongs to precision machining technical field.

TECHNICAL BACKGROUND

The disk parts whose radial dimension is generally larger than axial dimension are common typical parts in machine parts, and have high precision requirement for end beat, cylindricity of the inner hole, the circular runout and the total run-out of the cylindrical surface. The axial reference of the disk part is the two ends, and the radial reference is the axis determined by the cylinder surface of the inner hole. Due to the mandrel has machining errors and the installation eccentricity error, when taking the inner hole as datum to machine the external cylindrical surface, it is difficult to guarantee the coaxiality of the external cylindrical surface and the datum cylindrical surface of the inner hole. Even though the roundness error of external cylindrical surface is smaller, the larger circular runout and larger total run-out of cylindrical surface of the disk part would be produced due to the concentricity errors of the inner and the external cylindrical surface.

The typical products of the disk parts include bearing encloses, friction wheels, base circle plates of the reference level involute measuring apparatus, the reference disks of roundness instrument and so on. In the field of measurement, the accuracy requirement of the disk part used as a datum for roundness is to submicron or nanometer level. The current machining equipment and ultra-precision grinding process cannot meet the processing requirements of such disk part. Lapping is a kind of ultra-precision machining processing, which is mainly used for machining plane, cylindrical surface and spherical surface. At present, the flatness of plane lapping can be attained to 0.2~0.5 μm. The roundness of cylindrical lapping can be attained to 0.2~0.5 μm and the cylindricity can be attained to 0.5~1 μm. The ultra-precision lapping technology is used to process class-1 standard optical flat with a diameter of 150 mm and the flatness can be attained to below 50 nm. However, the present polishing processes and devices are only suitable for ultra-precision machining of flat and spherical parts.

Contents of the Invention

In order to solve the problem improving the machining accuracy of the disk part cylindrical surface to submicron or nanometer level, the invention provides a precision machining device for the external cylindrical surface of the disk part by adopting a lapping and polishing process and taper error adjustment method of the device. Ultra-precision machining for cylindrical surface of the disk part can be realized according to the working principle that the generatrix rotates around the fixed axis to form the cylinder surface.

The precision machining device for the external cylindrical surface by adopting a lapping and polishing process is composed of a circular baseplate, two slant rails, two baffles, two pressure plates, two copper blocks, a washer racket; two blanket plates, a set of bead shafting, a friction driving wheel, a DC motor, a mobile power supply, a LED lamp and a cover body.

The circular baseplate is made of nodular cast iron, and the ratio of its thickness to the diameter is 0.1~0.3, wherein there is an inverted trapezoidal slot whose width is larger than the thickness of the disk part to be ground. When the disk part is fixed, the cylindrical surface of it is internally tangent to the bottom of the circular baseplate. On the vertical side of the inverted trapezoidal slot to the generatrix of the disk part, there is a plane orthogonal to the circular baseplate with the height of 3~6 mm, where the LED chip is attached to provide the light source for the light-gap measurement method. On the opposite to the plane, there is an observation slot with height of 2~4 mm, and its width is larger than the length of the generatrix of the disk part to be ground, so it is convenient to judge the installation accuracy and machining accuracy of the generatrix of the disk part by the light-gap measurement method. Several counterbore holes are machined on the circular baseplate for fixing the slant rails and the bracket of the friction driving wheel.

The circular baseplate can realize the following functions: (1) Supporting the entire precision machining device; (2) Dressing the lapping platform; (3) Realizing radial-continuous-automatic-micro feeding of the disk part whose generatrix is internal tangent to the bottom surface of the circular baseplate by thinning thickness; (4) Judging the installation accuracy and machining accuracy of the generatrix of the disk part by the light-gap measurement method.

The two slant rails are connected to the circular baseplate by screws, the inclination angle between the working surface of the slant rails and the bottom surface of the circular baseplate is 60-75°. A T-shaped slot is machined in the middle of each slant rail for fixing the baffles and the pressure plates. The two slant rails' working surfaces are coplanar after the installation to the circular baseplate. The slant rails can realize the following functions: (1) Location and supporting the disk part in a certain diameter range; (2) Connecting of the baffle and the pressure plate; (3) Adjusting the axial taper error of the disk part.

The two baffles and two pressure plates are fixed on the slant rails respectively by screws and T-shaped nuts to realize fixing and adjusting the mandrel of the disk part. The baffle is of L-shaped and its two working surfaces are vertical. The location surface with the counterbore hole contacts with the working surface of the slant rail, the other working surface of that is tangent to the cylindrical surface of the mandrel. The pressure plate is of inverse Z-shaped whose location surface with the counterbore hole contacts with the working surface of the slant rails. The angle between the pressure surface and the location surface of the pressure plate is not larger than the complement angle of the inclination angle of the slant rail's working surface. To improve the location rigidity and stability of the mandrel, the inner side of the pressing surface of the pressure plate is fixed by fastening screws and the copper block is tightly contacted with the mandrel.

A set of bead shafting consists of a mandrel, two annular-flat bead plates, a radial bead sleeve, a cross washer, a washer bracket and a lock nut. A shaft shoulder with an end surface perpendicular to its axis and three location shaft sections are machined on the mandrel. The end of shaft shoulder is an axial location datum of the disk part, and its deflection error is not larger than 1 μm relative to the location shaft section of the disk part. The diameter deviation between two location shaft sections is not larger than 2 m and the cylindricity is not larger than 1 m, which is used as the location datum of the mandrel on the slant rails. The annular-flat bead plates and the radial bead sleeve are made of spherical rollers and copper cage. Taking the rollers in the annular-flat bead plate contact with the mandrel shoulder and the washer bracket by controlling the preload of the lock nut. The washer bracket is long-strip type whose thickness is 2~3 mm, wherein there is a hole in the middle of annular-flat plates and cross washer, and the diameter of the hole is larger than the nominal diameter of the spindle thread by 0.5~1 mm. The washer bracket is fixed to the mandrel by the cross washer and the lock nut, and the washer bracket extends symmetrically along the core radial direction to both sides. The length of the washer bracket is larger than the maximum diameter of the disk part, but not exceed the inner diameter of the cover body, wherein there is a slot in the middle of the extending section of the washer bracket, and the washer bracket connects with the L-shaped blanket plates by screws. The blanket pieces whose length is larger than the axial width of the cylindrical surface of the disk part to be ground by 3~10 mm is adhesive to the L-shaped blanket plate. The blanket pieces can realize the following functions: (1) Removing the polishing liquid on the disk part in time to prevent the disk part and friction drive wheel slipping; (2) Polishing the cylindrical surface of the disk part and improve its degree of finish.

The portable power is fixed on the circular baseplate. The DC motor and the friction driving wheel connect to the circular baseplate by the motor bracket. The width of the friction driving wheel is larger than the axial width of cylindrical surface of the disk part to be ground.

The friction driving wheel is made of rubber or silica gel with larger friction coefficient, and it is sheathed on the steel shaft through the interference fit. The transparent cover body is covered on the external part of the device and fixed on the circular baseplate by the dowel pins.

Furthermore, the flatness of the bottom surface of the circular baseplate, the working surface of the two slant rails and the two baffles are not larger than 1 μm. The flatness of the location surface of the two pressure plates contacting to the slant rails are less than 2 μm. The Rockwell hardness of the working surface of the two slant rails and baffles are not less than HRC60.

Furthermore, the length of copper block is less than that of the mandrel location shaft sections by 2~5 mm. The contact surface of the copper block to the mandrel is arc surface, which the diameter of the arc surface is larger than that of location shaft sections of the mandrel by 1~3 mm. Such structure can reduce the pressure of the copper block to location shaft sections of the mandrel, and it helps to protect the location shaft sections of the mandrel from being worn.

Furthermore, the annular-flat bead plates and the radial bead sleeve are made of G5 and above class precision rollers. The rollers in the radial bead sleeve interferes to inner hole of the disk part and the mandrel by 1~3 μm.

Furthermore, the cover body is made of plastic material, and the blowholes with 2~3 mm diameter are uniformly distributed near the bottom of the cover body, and the dust filter screen is installed on the inner wall of the cover body. A portable temperature and humidity instrument through the small hole at the top of the cover body is installed in the position of 1~5 mm above the disk part to collect the temperature and humidity data around the disk part during the process. A micro speed-adjustable fan is installed at the middle hole of the top of the cover body to adjust the temperature of the processing environment. When the relative humidity in the processing room is larger than 60%, silica gel and other desiccant can be placed in the hood of the cover body to reduce the humidity.

Furthermore, to facilitate the transportation of the device, the holes in the periphery of the circular baseplate plate is processed, in which the handling handles are installed. Two dowel pins are fixed on the circular baseplate for the location of the cover body. The blanket piece descripted above is made of wool blanket.

The taper error adjustment method of the precision lapping and polishing device for external cylindrical the disk part is padding precision washers on the working surface of the baffle and the slant rail. The specific adjustment methods are as follows:

(1) Padding Washers on the Working Surface of the Baffle.

Step 1, the mapping relationship between the normal thickness difference $T_1$ of the two baffle working surfaces and the axial taper error Δ of the disk part is $T_1=L\Delta/(l \sin\theta)$, wherein l is the axial width of the disk part, L is the center span of T-shaped slot of the two slant rails and the inclination angle of slant rail's working surface is θ. Three sets of class-1 and above gage blocks are selected as adjusting washers, which are divided into three groups A1, B1 and C1, and their thickness is $t_0 \sin\theta$, $t_0$ and $t_0 \sin\theta+T_1$ respectively.

Step 2, gage blocks of group B1 are padded in the middle of the disk part and the high precision platform, then gage blocks of group A1 and group C1 are padded on the working surface of both sides of the baffles respectively. The gage blocks of group A1 are padded on the one side that the taper error of the disk part is bigger, and the gage blocks of group C1 are padded on the one side that the taper error of the disk part is smaller. The disk part is installed on the mandrel, and both sides of the baffles are fixed on the slant rail to keep the location shaft sections of the mandrel being tangent to the working surface of the slant rails and gage blocks of group A1 and group C1. The mandrel and the disk part as well as the gage blocks of group A1, B1 and C1 are removed. Finally, the disk part and the mandrel are fixed on the slant rails. At this moment, the taper error Δ produced between generatrix of the disk part and the bottom of the circular baseplate. As the process of lapping and polishing is ongoing, the generatrix of the disk part would be tangent to the working surface of the circular baseplate. Finally, the precise elimination of axial taper error of the disk part is realized.

(2) Padding Washers on the Working Surface of the Slant Rail.

Step 1, the mapping relationship between the normal thickness difference $T_2$ of working surface to the slant rail and the axial taper error Δ of the disk part is $T_2=L\Delta/(\cos\theta)$. Three sets of class-1 and above gage blocks are selected as adjusting washers, which are divided into three groups A2, B2 and C2, and their thickness is $t_0 \cos\theta$, $t_0$ and $t_0 \cos\theta+T_2$ respectively.

Step 2, the gage blocks of group B2 are padded in the middle of the disk part and the high precision platform, then the gage blocks of group A2 and group C2 are padded on the working surface of both sides of the slant rails respectively. The gage blocks of group A2 are padded on the one side that the taper error of the disk part is bigger, and the gage blocks of group C2 are padded on the one side that the taper error of the disk part is smaller. The disk part is installed on the mandrel, and both sides of the baffles are fixed on the slant rail to keep the mandrel location shaft sections being tangent to the slant rail and gage blocks of group A2 and group C2. Then we remove the mandrel and the disk part as well as the gage blocks of group A2, B2 and C2. Finally, the disk part and the mandrel are fixed on the slant rail. At this moment, the taper error Δ produced between generatrix of the disk part and the bottom of the circular baseplate. As the process of lapping and polishing is ongoing, the generatrix of the disk part and the working surface of the circular baseplate would be tangent. Finally, the precise elimination of axial taper error of the disk part is realized.

The beneficial effect of the invention is that the invention provides a device for finishing cylindrical surface of the disk part on lapping-polishing machine or lapping platform by using lapping and polishing technology. By adopting the working principle that the generatrix rotates around the fixed axis to form the cylindrical surface, the ultra-precision machining of the cylindrical surface of the disk part is realized. No feeding is needed during the machining process by adopting the polishing device and the machining method that the radial-continuous-automatic-micro feeding of the disk part is realized by thinning the thickness of the circular baseplate which is internally tangent to the generatrix of the circular baseplate during the process of lapping and polishing. The installation and processing accuracy of the disk part can be adjusted by adopting the device and the light-gap measurement method. It is also convenient to adjust the axial taper error of the disk part by padding washers on the working surface of the baffle and the slant rail. Besides, the device can be used to achieve ultra-precision machining of the external cylindrical surface of the disk part at sub-micron or even nanometer level, which has the advantages of operating simply, adjusting conveniently, low cost and is of important value for popularization and application.

BRIEF DESCRIPTIONS OF THE DRAWINGS

Figure 1:
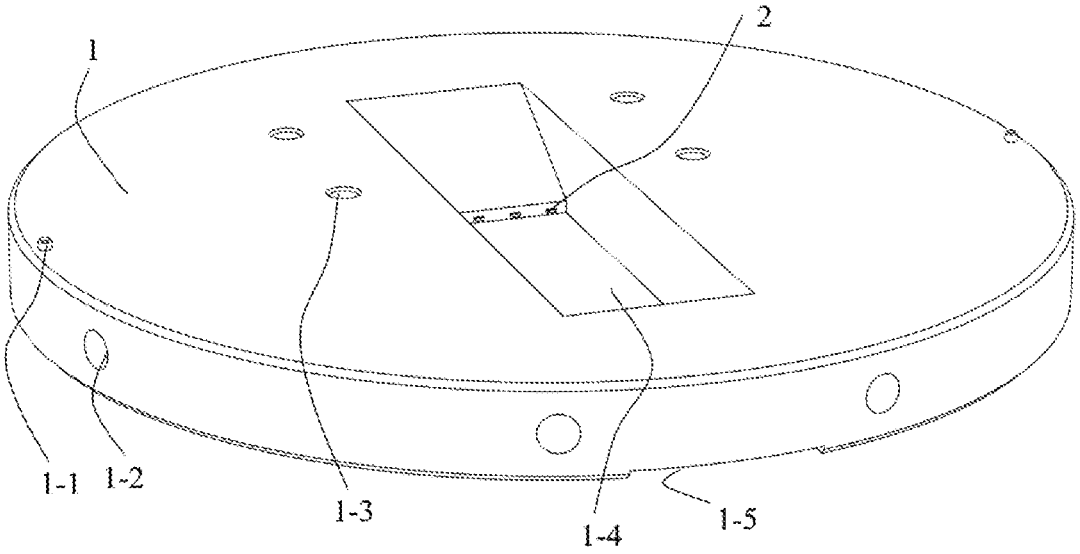
FIG. 1 illustrates a circular baseplate.
Figure 2:
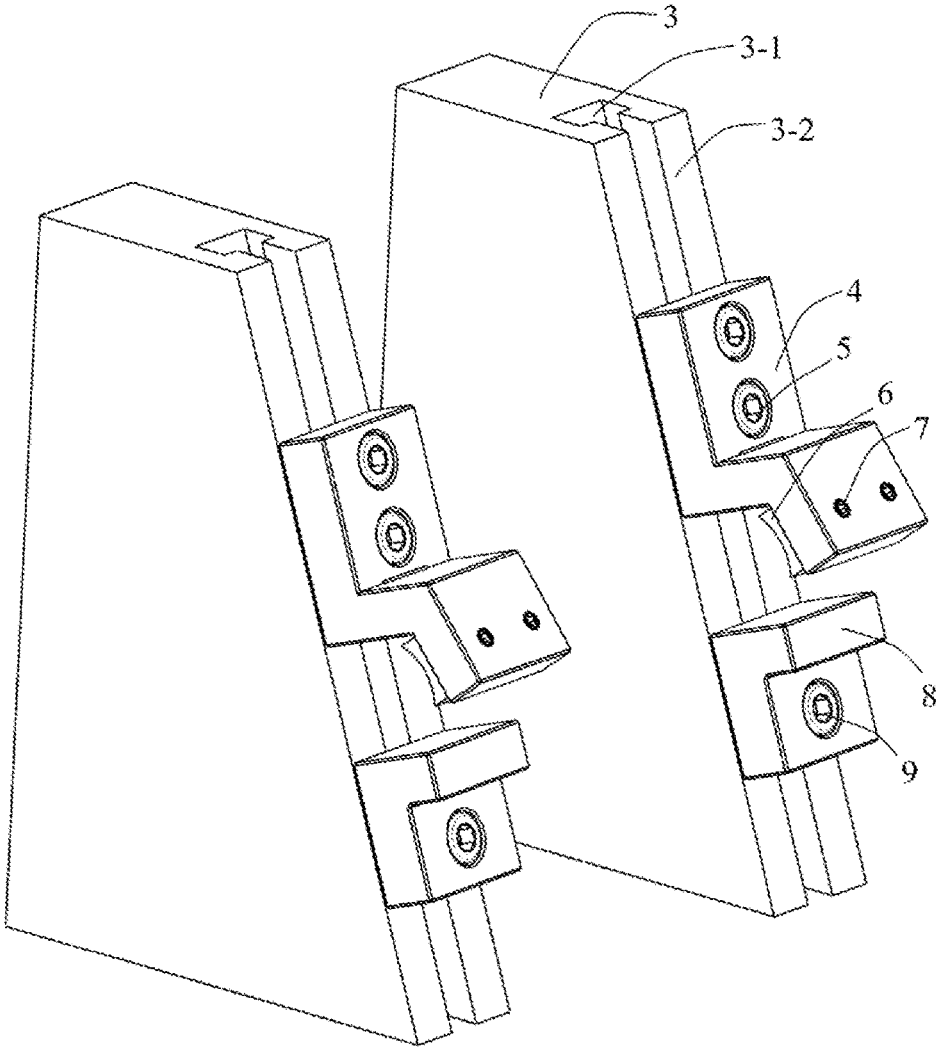
FIG. 2 illustrates the two slant rails and location and pressing device of the mandrel.
Figure 3:
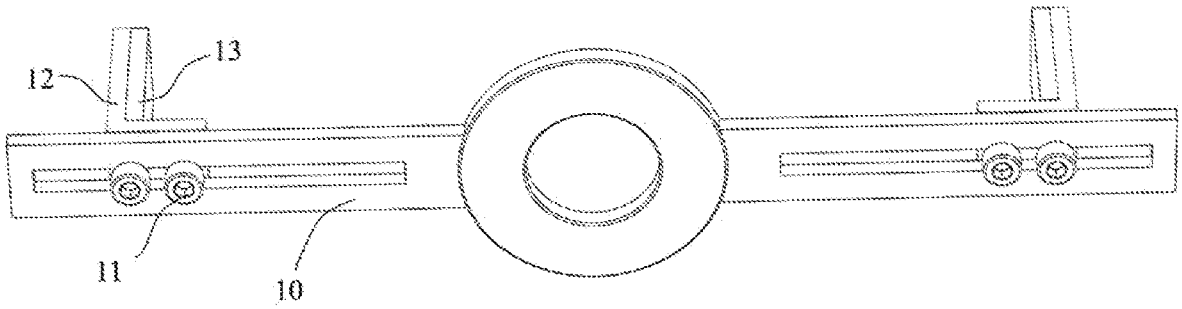
FIG. 3 illustrates a washer bracket.
Figure 4:
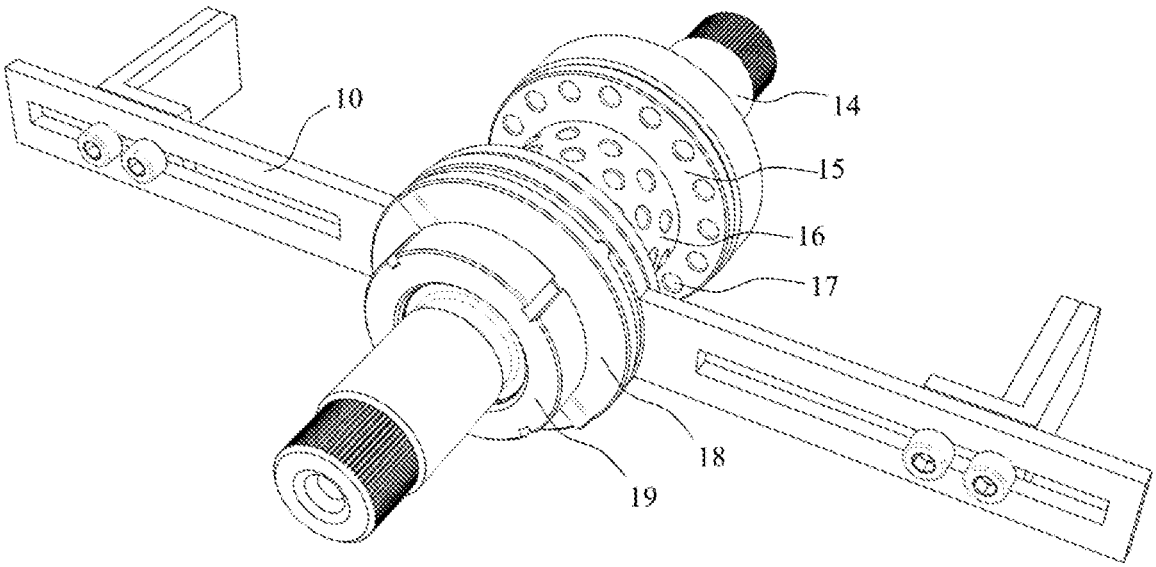
FIG. 4 illustrates a bead shafting.
Figure 5:
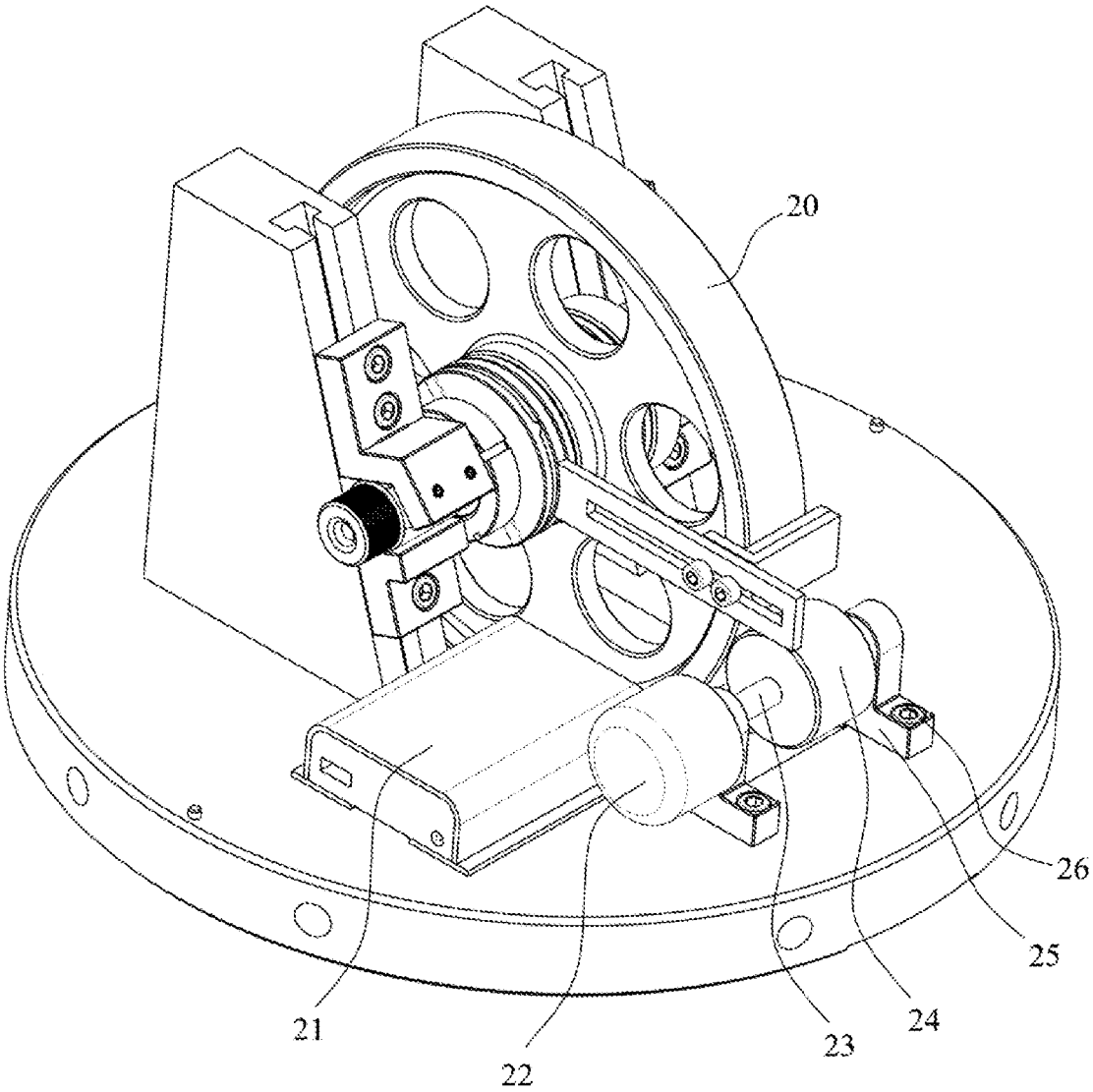
FIG. 5 illustrates a lapping and polishing device for the disk part.
Figure 6:
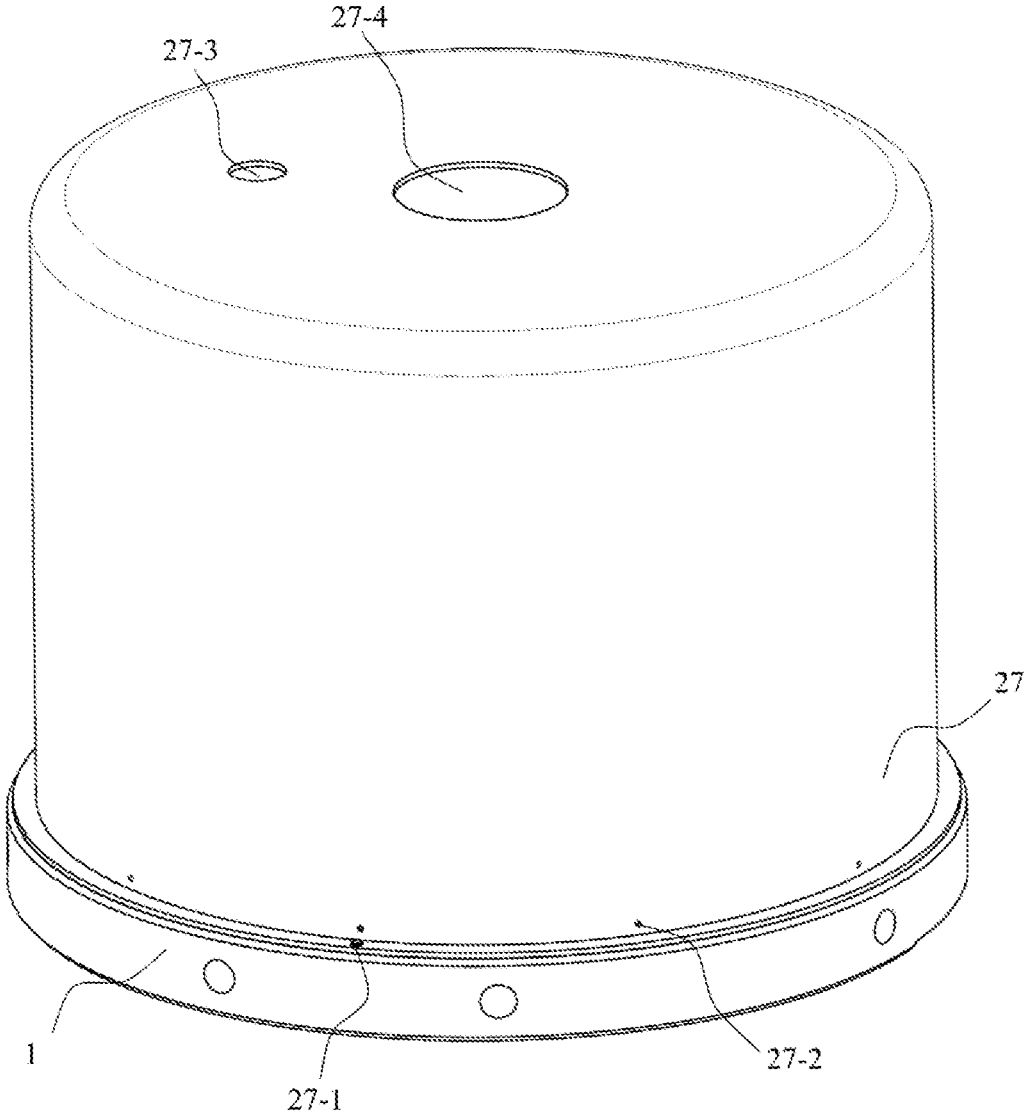
FIG. 6 illustrates a plastic cover and circular baseplate.
Figure 7:
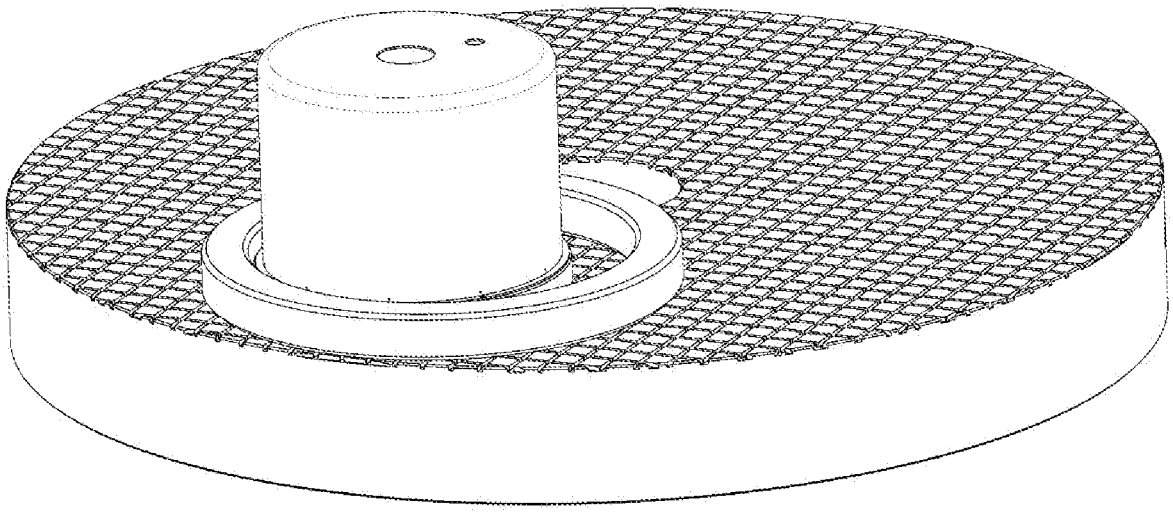
FIG. 7 illustrates a schematic diagram of polishing for the disk part.

wherein, 1 illustrates the circular baseplate; 1-1 illustrates the dowel pin of the plastic cover; 1-2 illustrates the sockets for transport; 1-3 illustrates the countersunk hole for connection to the slant rail; 1-4 illustrates the inverted trapezoid slot; 1-5 illustrates the observation hole by the light-gap measurement method; 2 illustrates the LED lamp; 3 illustrates the slant rails; 3-1 illustrates the T-shaped slot of the slant rails; 3-2 illustrates the working surface of the slant rails; 4 illustrates the pressure plate; 5 illustrates the fixing screw for the pressure plate; 6 illustrates the copper blocks; 7 illustrates the fastening screws for copper block; 8 illustrates the baffles; 9 illustrates the fixing screws for the baffle; 10 illustrates the washer bracket; 11 illustrates the connecting screws for blanket plate; 12 illustrates the blanket plate; 13 illustrates the blanket piece; 14 illustrates mandrel; 15 illustrates the annular-plane bead plate; 16 illustrates the radial bead sleeve; 17 illustrates the spherical rollers; 18 illustrates the cross washer; 19 illustrates the lock nut; 20 illustrates the disk part; 21 illustrates the portable power source; 22 illustrates the DC motor; 23 illustrates the steel shaft; 24 illustrates the friction wheel; 25 illustrates the bracket for friction wheel; 26 illustrates the fixing screw for bracket; 27 illustrates the cover body; 27-1 illustrates the location hole; 27-2 illustrates the blowholes; 27-3 illustrates the installation hole of probe for temperature and humidity instrument; 27-4 illustrates the installation hole of the micro fan.

Concrete Implementation Modes

1. Installation of the Disk Part

According to the size of the disk part 20, we can confirm the diameter of the circular baseplate 1, the width of the inverted trapezoidal slot 1-4 and the height of the slant rails 3. The maximum machining width of the disk part 20 is less than the width of the inverted trapezoidal slot 1-4. The minimum diameter of the disk part 20 is determined by the length of the baffle 8, the diameter of the location shaft sections of the mandrel 14 and the thickness of the circular baseplate 1. The maximum machining diameter of the disk part is limited by the height of the slant rails 3 and the length of the inverted trapezoidal slot 14. Therefore, the device can meet the precision processing of the cylindrical surface of the disk part in a certain range.

Without the interference with the disk part 20, the working surface 3-2 of the two slant rails 3 can be rigidly connected with each other, and the overall lapping surface would meet the flatness requirements of not larger than 1 μm. At the same time, the location surface of the slant rails 3 is coplanar. Then, the slant rails 3 are fixed on the circular baseplate 1. Due to the assembly stress and the difference of the pre-tightening force of screw connection between the two slant rails and the circular baseplate, it is inevitably that the working surface of the slant rail would be micro warpage. After the stress is released, we can further improve the flatness of the slant rails' working surface by integrally lapping of the slant rails.

First, the disk part 20 is installed on the mandrel 14. The installation methods are as follows: The mandrel 14 is put vertically and the end with the shaft shoulder is laid down. Then the annular-flat bead plate 15, the radial bead sleeve 16 and the disk part 20, the another annular-flat bead plate 15, the washer bracket 10, the cross washer 18, the lock nut 19 are installed in order. When the lock nut is in contact with the cross washer 18, three radial setting screws are lighten on the lock nut. And two annular-flat bead plates 15 and the radial bead sleeve 16 are filled with low viscosity grease.

Second, the circular baseplate 1 is put on the high precision platform or lapping plate, and the mandrel 14 is installed the disk part 20 into the inverted trapezoidal slot 1-4. Next, the location shaft sections of the mandrel 14 is tangent to the baffle 8, which is fixed to T-shaped slot 3-1 of the slant rails 3. In order to avoid changing the conditions that the location shaft sections of the mandrel 14 is tangent to the baffle 8, a small amount of lubricating oil is added into the torus of baffle 8 counterbore hole when the baffle fixing screws 9 are tightening. The generatrix of the disk part 20 and the circular baseplate 1 are both aligned with the working surface of high precision platform to ensure that the generatrix of the disk part 20 is tangent to the working surface of the circular baseplate 1.

Two pressure plates 4 are fixed on the slant rails 3 respectively, and then we adjust the position of the copper block 6 and tightening screws 7 of the pressure plates, so that the mandrel 14 is pressed against the slant rail 1 and baffle 8 to improve installation rigidity and stability of the mandrel 14 and the slant rails 3.

Finally, the DC motor 22 and the friction driving wheel 14 are installed, and the friction driving wheel 24 are adjusted to the disk part 20 with maximum contact. The position of the bracket of the DC motor 25 on the circular baseplate 1 is adjusted to produce a certain positive pressure between the friction driving wheel 24 and the disk part 20, then the friction torque is formed and drive the disk part 20 to rotate at constant speed. By controlling the speed of the disk part 20 at 3-12 r/min, the better lapping and polishing effect is obtained.

2. Adjustment of Taper Error of the Disk Part (1) Adjustment Method 1: Padding Washers on the Working Surface of the Baffles 8.

Setting the axial width of the disk part is l, the span of T-shaped slot of the two slant rails is L, the inclination angle of slant rail's working surface is θ and the taper error of the disk part is Δ. The mapping relation between the normal thickness difference $T_1$ of the both sides of baffle's working surface and the taper error Δ of the disk part is $T_1=L\Delta/(\sin\theta)$.

Three sets of gage blocks with class-1 and above class are selected as adjusting washers, which are divided into three groups A1, B1 and C1, and their thickness is $t_0 \sin\theta$, $t_0$ and $t_0 \sin\theta+T_1$ respectively.

Gage blocks of group B1 are padded in the middle of the disk part and the high precision platform, then gage blocks of group A1 and group C1 are padded on the working surface of both sides of the baffles respectively. Gage blocks of group A1 are padded on the one side that the taper error of the disk part is bigger, and gage blocks of group C1 are padded on the one side that the taper error of the disk part is smaller. The disk part is installed on the mandrel, and both sides of the baffles are fixed on the slant rails to keep the location shaft sections of the mandrel being tangent to the slant rails and gage blocks of group A1 and group C1. Then we remove the mandrel and the disk part as well as the gage blocks of group A1, B1 and C1. Finally, the disk part and the mandrel are fixed on the slant rails. At this moment, the taper error Δ produced between generatrix of the disk part and the working surface of the circular baseplate. As the process of lapping and polishing is ongoing, the working surface of the generatrix of the disk part would be tangent to the working surface of the circular baseplate. Finally, the precise elimination of axial taper error of the disk part is realized.

Further examples are given as follows:

Set L/l=4 and θ=75°. The stainless steel piece with minimum thickness of 0.01 mm is selected to pad on one side of the baffle with maximum taper error (That is to say, $t_0=0$), and the minimum taper error of the circular baseplate can meet 2.41 μm. Besides, the thickness error of class-0 gage blocks in a set is not larger than 1 μm. When adopting the class-0 gage blocks to adjust the tapper error, the influence on the taper error of the disk part is less than 0.24 μm. It is obvious that the ultra-precision machining of the external cylindrical surface of the disk part at sub-micron can be realized by adopting the adjusting method that is padding gage blocks on the working surface of the baffle.

(2) Adjustment Method 2: Padding Washers on the Working Surface of the Slant Rails 3.

Set the axial width of the disk part is 1, the span of T-shaped slot of the two slant rails is L, the inclination angle of slant rail's working surface is θ and the taper error of the disk part is Δ. The mapping relation between the normal thickness difference $T_2$ of the both sides of slant rails' working surface and the taper error Δ of the disk part is $T_2$ $L\Delta/(l \cos\theta)$.

Three sets of gage blocks with class-1 and above class-are selected as adjusting washers, which are divided into three groups A2, B2 and C2, and their thickness is $t_0 \cos\theta$, $t_0$ and $t_0 \cos\theta+T_2$ respectively. The gage blocks of group B2 are padded in the middle of the disk part and the high precision platform, then the gage blocks of group A2 and group C2 are padded on the working surface of both sides of the slant rails respectively. The gage blocks of group A2 are padded on the one side that the taper error of the disk part is bigger, and the gage blocks of group C2 are padded on the one side that the taper error of the disk part is smaller. The disk part is installed on the mandrel, and both sides of the baffles are fixed on the slant rails to keep the mandrel location shaft sections being tangent to the slant rail and gage blocks of group A2 and group C2. Then we remove the mandrel and the disk part as well as the gage blocks of group A2, B2 and C2. Finally, the disk part and the mandrel are fixed on the slant rail. At this moment the taper error Δ produced between generatrix of the disk part and the working surface of the circular baseplate. As the process of lapping and polishing is ongoing, the working surface of the generatrix of the disk part would be tangent to the working surface of the circular baseplate. Finally, the precise elimination of axial taper error of the disk part is realized.

Further examples are given as follows:

Set L/l=4 and θ=75°. The stainless steel piece with minimum thickness of 0.01 mm is selected to pad on one side of the working surface of the slant rail with maximum taper error (That is to say, $t_0=0$), and the minimum taper error of the disk part is 0.64 μm. Besides, the thickness error of class-0 gage blocks in a set is not larger than 1 μm. When adopting the class-0 gage blocks to adjust the tapper error, the influence on the taper error of the disk part is less than 0.07 μm. It is obvious that the ultra-precision machining of the external cylindrical surface of the disk part at nanometer level can be realized by adopting the adjusting method that is padding gage blocks on the working surface of the slant rail.

The invention claimed is:

1. A precision lapping and polishing device for external cylindrical surface of the disk part, wherein it comprises: a circular baseplate, two slant rails, two baffles, two pressure plates, two copper blocks, a washer bracket, two blanket plates, a set of bead shafting, a friction driving wheel, a DC motor, a mobile power supply, a LED lamp, and a cover body; wherein the circular baseplate is made of nodular cast iron and the ratio of its thickness to the diameter is 0.1~0.3; wherein there is an inverted trapezoidal slot whose width is larger than the thickness of the disk part to be ground; when the disk part is fixed, the cylindrical surface of it is internally tangent to the bottom of the circular baseplate; on the vertical side of the inverted trapezoidal slot to the generatrix of the disk part, there is a plane orthogonal to the circular baseplate with the height of 3~6 mm where the LED chip is attached to provide the light source for the light-gap measurement method; on the opposite to the plane, there is an observation slot with height of 2~4 mm, and its width is larger than the length of the generatrix of the disk part to be ground; several counterbore holes are machined on the circular baseplate for fixing the slant rails and the bracket of the friction driving wheel;

the two slant rails are connected to the circular baseplate by screws, the inclination angle between the working surface of the slant rails and the bottom surface of the circular baseplate is 60°-75°; a T-shaped slot is machined in the middle of each slant rail for fixing the baffles and the pressure plates; the two slant rails' working surfaces are coplanar after installing to the circular baseplate;

the two baffles and two pressure plates are fixed on the slant rails respectively by screws and T-shaped nuts to realize fixing and adjusting the mandrel of disk part; the baffle is of L-shaped and its two working surfaces are vertical; the location surface with the counterbore hole contacts with the working surface of the slant rail, the other working surface of that is tangent to the cylindrical surface of the mandrel; the pressure plate is of inverse Z-shaped whose location surface with the counterbore hole contacts with the working surface of the slant rails; the angle between the pressure surface and the location surface of the pressure plate is not larger than the complement angle of the inclination angle of the slant rails' working surface; the inner side of the pressing surface of the pressure plate is fixed by fastening screws and the copper block is tightly contacted with the mandrel;

a set of bead shafting consists of a mandrel, two annular-flat bead plates, a radial bead sleeve, a cross washer, a washer bracket and a lock nut; a shaft shoulder with an end surface perpendicular to its axis and three location shaft sections are machined on the mandrel; the end of shaft shoulder is an axial location datum of disk part, and its deflection error is not larger than 1 μm relative to the location shaft section of the disk part; the diameter deviation between two location shaft sections is not larger than 2 μm and the cylindricity is not larger than 1 μm, which is used as the location datum of the mandrel on the slant rails; the annular-flat bead plates and the radial bead sleeve are made of spherical rollers and copper cage; taking the rollers in the annular-flat bead plate contact with the mandrel shoulder and the washer bracket by controlling the preload of the lock nut; the washer bracket is long strip type whose thickness is 2~3 mm, wherein there is a hole in the middle of annular-flat plate and cross washers, and the diameter of the hole is larger than the nominal diameter of the spindle thread by 0.5~1 mm; the washer bracket is fixed to the mandrel by the cross washer and the lock nut, and the washer bracket extends symmetrically along the core radial direction to both sides; the length of the washer bracket is larger than the maximum diameter of the disk part, but not exceed the inner diameter of the cover body, wherein there is a slot in the middle of the extending section of the washer bracket, and the washer bracket connects with the L-shaped blanket plates by screws; the wool blanket whose length is larger than the axial width of the cylindrical surface of the disk part to be ground by 3~10 mm is adhesive to the L-shaped blanket plate;

the portable power is fixed on the circular baseplate; the DC motor and the friction driving wheel connects to the circular baseplate by the motor bracket; the width of the friction driving wheel is larger than the axial width of cylindrical surface of the disk part to be ground; the friction driving wheel is made of rubber or silica gel with larger friction coefficient, and it is sheathed on the steel shaft through the interference fit; the transparent cover body is covered on the external part of the device and fixed on the circular baseplate by the dowel pins.

2. The precision lapping and polishing device for external cylindrical surface of the disk part according to claim 1, wherein the flatness of the bottom surface of the circular baseplate, the working surface of the two slant rails and the two baffles are not larger than 1 μm; the flatness of the location surface of the two pressure plates contacting to the slant rails are less than 2 μm; the Rockwell hardness of the working surface of the two slant rails and baffles are not less than HRC60.

3. The precision lapping and polishing device for external cylindrical surface of the disk part according to claim 1, wherein the length of copper block is less than that of the mandrel location shaft sections by 2~5 mm; the contact surface of the copper block to the mandrel are arc surface whose diameter is larger than that of location shaft sections of the mandrel by 1~3 mm.

4. The precision lapping and polishing device for external cylindrical surface of the disk part according to claim 1, wherein the annular-flat bead plates and the radial bead sleeve are made of G5 and above class precision rollers, wherein the rollers in the radial bead sleeve interferes to inner hole of the disk part and the mandrel by 1~3 μm.

5. The precision lapping and polishing device for external cylindrical surface of the disk part according to claim 3, wherein the annular-flat bead plates and the radial bead sleeve are made of G5 and above class precision rollers, wherein the rollers in the radial bead sleeve interferes to inner hole of the disk part and the mandrel by 1~3 μm.

6. The precision lapping and polishing device for external cylindrical surface of the disk part according to claim 1, wherein the cover body is made of plastic material, and the blowholes with 2~3 mm diameter are uniformly distributed near the bottom of the cover body, and the dust filter screen is installed on the inner wall of the cover body; a portable temperature and humidity instrument through the small hole at the top of the cover body is installed in the position of 1~5 mm above the disk part; a micro speed-adjustable fan is installed at the middle hole of the top of the cover body.

7. The precision lapping and polishing device for external cylindrical surface of the disk part according to claim 3, wherein the cover body is made of plastic material, and the blowholes with 2~3 mm diameter are uniformly distributed near the bottom of the cover body, and the dust filter screen is installed on the inner wall of the cover body; a portable temperature and humidity instrument through the small hole at the top of the cover body is installed in the position of 1~5 mm above the disk part; a micro speed-adjustable fan with is installed at the middle hole of the top of the cover body.

8. The precision lapping and polishing device for external cylindrical surface of the disk part according to claim 4, wherein the cover body is made of plastic material, and the blowholes with 2~3 mm diameter are uniformly distributed near the bottom of the cover body, and the dust filter screen is installed on the inner wall of the cover body; a portable temperature and humidity instrument through the small hole at the top of the cover body is installed in the position of 1~5 mm above the disk part; a micro speed-adjustable fan is installed at the middle hole of the top of the cover body.

9. The precision lapping and polishing device for external cylindrical surface of the disk part according to claim 1, wherein the holes in the periphery of the circular baseplate plate is processed, in which the handling handles are installed; two dowel pins are fixed on the circular baseplate for the location of the cover body.

10. A taper error adjustment method of the precision lapping and polishing device for external cylindrical surface of the disk part according to anyone of claim 1, wherein it is padding precision washers on the working surface of the baffle and the slant rail, wherein the specific adjustment methods are as follows:

(1) padding washers on the working surface of the baffle step 1, the mapping relationship between the normal thickness difference $T_1$ of the two baffle working surfaces and the axial taper error A of the disk part is $T_1=L\Delta/(l \sin \theta)$, wherein 1 is the axial width of the disk part, L is the center span of T-shaped slot of the two slant rails and the inclination angle of slant rails' working surface is θ; three sets of class-1 and above gage blocks are selected as adjusting washers, which are divided into three groups A1, B1 and C1, and their thickness is $t_0 \sin\theta$, $t_0$ and $t_0 \sin\theta+T_1$ respectively;

step 2, gage blocks of group B1 are padded in the middle of the disk part and the high precision platform, then gage blocks of group A1 and group C1 are padded on the working surface of both sides of the baffles respectively; the gage blocks of group A1 are padded on the one side that the taper error of disk part is bigger, and the gage blocks of group C1 are padded on the one side that the taper error of disk part is smaller; the disk part is installed on the mandrel, and both sides of the baffles are fixed on the slant rail to keep the location shaft sections of the mandrel being tangent to the working surface of the slant rails and gage blocks of group A1 and group C1; the mandrel and the disk part as well as the gage blocks of group A1, B1 and C1 are removed; finally, the disk part and the mandrel are fixed on the slant rails; at this moment, the taper error Δ produced between generatrix of the disk part and the bottom of the circular baseplate; as the process of lapping and polishing is ongoing, the generatrix of disk part would be tangent to the working surface of the circular baseplate; finally, the precise elimination of axial taper error of disk part is realized;

(2) padding washers on the working surface of the slant rail step 1, the mapping relationship between the normal thickness difference $T_2$ of working surface to the slant rail and the axial taper error A of the disk part is $T_2=L\Delta/(l \cos\theta)$; three sets of class-1 and above gage blocks are selected as adjusting washers, which are divided into three groups A2, B2 and C2, and their thickness is $t_0 \cos\theta$, $t_0$ and $t_0 \cos\theta+T_2$ respectively;

step 2, the gage blocks of group B2 are padded in the middle of the disk part and the high precision platform, then the gage blocks of group A2 and group C2 are padded on the working surface of both sides of the slant rails respectively; the gage blocks of group A2 are padded on the one side that the taper error of disk part is bigger, and the gage blocks of group C2 are padded on the one side that the taper error of disk part is smaller; the disk part is installed on the mandrel, and both sides of the baffles are fixed on the slant rails to keep the mandrel location shaft sections being tangent to the slant rail and gage blocks of group A2 and group C2; then the mandrel and the disk part as well as the gage blocks of group A2, B2 and C2 are removed; finally, the disk part and the mandrel are fixed on the slant rails; at this moment, the taper error Δ produced between generatrix of the disk part and the bottom of the circular baseplate; as the process of lapping and polishing is ongoing, the generatrix of disk part and the working surface of the circular baseplate would be tangent; finally, the precise elimination of axial taper error of disk part is realized.

* * * * *